US005421709A

United States Patent [19]

Hill et al.

[11] Patent Number: 5,421,709

[45] Date of Patent: Jun. 6, 1995

[54] OIL MANAGEMENT IN A HIGH-SIDE CO-ROTATING SCROLL COMPRESSOR

[75] Inventors: Joe T. Hill, Bristol, Va.; John R. Williams; Gene M. Fields, both of Bristol, Tenn.; Robert E. Utter, Whitehouse; John K. Wollitz, Tyler, both of Tex.

[73] Assignee: Alliance Compressors Inc., Tyler, Tex.

[21] Appl. No.: 240,187

[22] Filed: May 10, 1994

[51] Int. Cl.[6] ..... F01L 1/04

[52] U.S. Cl. ..... 418/55.6; 418/85; 418/188; 184/616; 184/6.22

[58] Field of Search ..... 418/55.6, 97, 98, 85, 418/188; 184/6.16, 6.22

[56] References Cited

U.S. PATENT DOCUMENTS

| | | | |
|---|---|---|---|
| 4,927,339 | 5/1990 | Riffe et al. | 418/55 |
| 4,958,993 | 9/1990 | Fujio | 418/97 |
| 5,066,206 | 11/1991 | Kakuda et al. | 418/188 |
| 5,080,566 | 1/1992 | Sakata et al. | 418/55 |
| 5,101,644 | 4/1992 | Crum et al. | 418/55.6 |
| 5,212,964 | 5/1993 | Utter et al. | 418/55.6 |
| 5,217,360 | 6/1993 | Kawahara et al. | 418/85 |

*Primary Examiner*—Richard A. Bertsch
*Assistant Examiner*—Charles G. Freay
*Attorney, Agent, or Firm*—William J. Beres; William O'Driscoll; Peter D. Ferguson

[57] ABSTRACT

A high-side co-rotating refrigerant scroll compressor defines a lubricant sump in its discharge pressure portion. Lubricant is directed from that sump, through a passage which is at least partially defined by the shell of the compressor, to the bearings in which the scroll members rotate. Heat carried in the lubricant flowing through the passage is transferred through the compressor shell to the ambient. Subsequent to having lubricated the bearing in which the drive scroll member rotates, lubricant is diverted into a passage defined by the drive scroll member drive shaft and enters the stream of compressed discharge gas flowing therethrough. The lubricant is thereby prevented from entering the suction pressure portion of the compressor where it would otherwise heat compressor suction gas prior to the entry of that gas into the compressor's compression mechanism.

24 Claims, 3 Drawing Sheets

FIG. 2
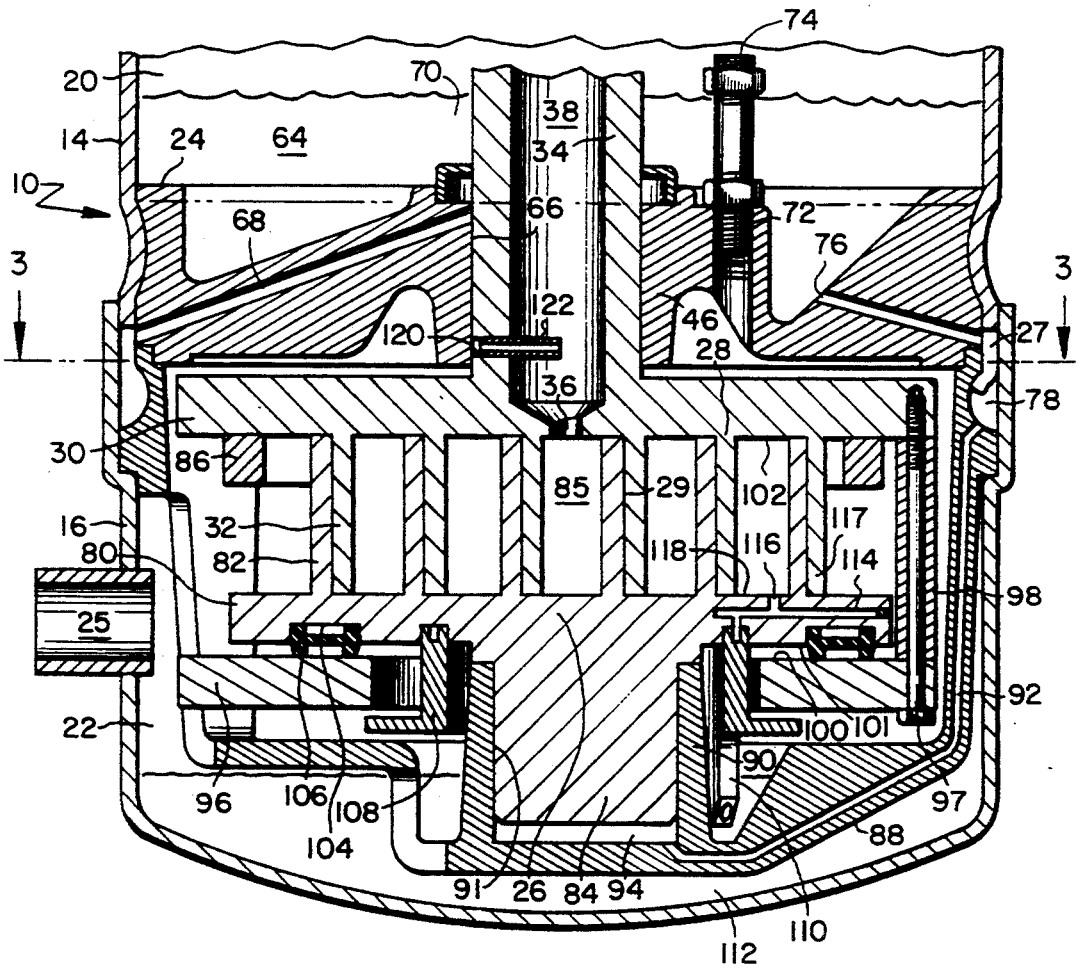
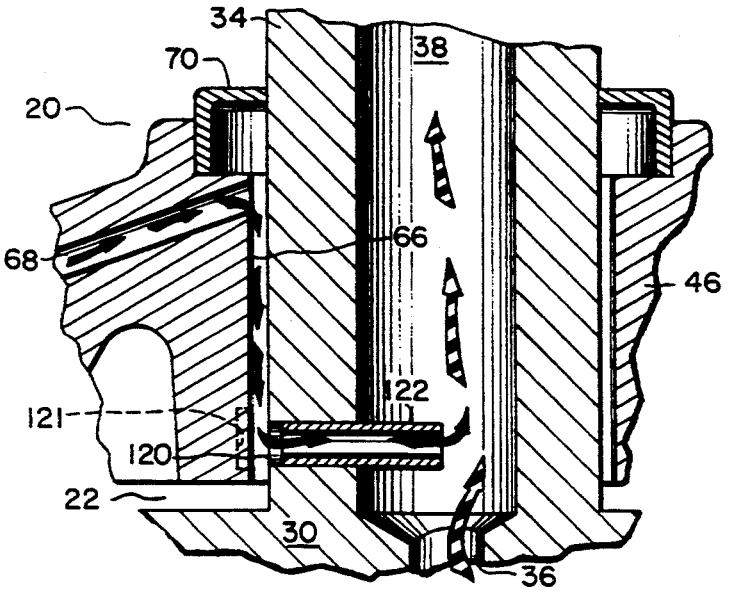
FIG. 4

OIL MANAGEMENT IN A HIGH-SIDE CO-ROTATING SCROLL COMPRESSOR

BACKGROUND OF THE INVENTION

This invention pertains generally to scroll apparatus of the type wherein both scroll members rotate on parallel offset axes. More specifically, this invention relates to high-side co-rotating refrigerant scroll compressors wherein (a) compressed refrigerant gas and the oil entrained therein is discharged through the drive shaft of the drive scroll member into the discharge pressure portion of the compressor shell and wherein (b) the lubricant entrained in such discharge gas is disentrained in the discharge pressure portion of the shell and is directed to a sump therein.

With still more particularity, the present invention relates to the cooling of lubricating oil sourced from a sump in the discharge pressure portion of a hermetic high-side co-rotating refrigerant scroll compressor, prior to its use for bearing lubrication purposes, and to the diversion of such lubricant, after it has been used for lubrication purposes, away from the suction pressure portion of the compressor shell. As a result, cooling of the lubricating oil is achieved while the heating of suction gas prior to its entry into the compressor's compression mechanism is reduced, all to the benefit of the overall efficiency and reliability of the compressor.

Scroll compression apparatus is typically comprised of two scroll members, each member having an involute or spiroidal wrap. The wraps of the scroll members extend from an end plate and are in an interleaved relationship. Relative orbital motion of one scroll member with respect to the other causes the creation of a series of pockets between the scroll wraps which, in operation and dependent on the direction of scroll member rotation, decrease in volume so as to compress any gas trapped therein.

Scroll compressors are typically of a first type, in which one of the scroll members is fixed while the other orbits thereabout, or a second type, known as co-rotating scroll compressors, in which both scroll members rotate on parallel offset axes. In a co-rotating scroll compressor, one of the scroll members is characterized as the drive scroll member while the other is characterized as the idler scroll member. The drive scroll member is drivingly coupled to the idler scroll member and is itself driven by a drive shaft which extends from the drive scroll member end plate. The drive scroll member drive shaft penetrates and is coupled for rotation with the rotor of the motor by which the compressor is driven.

Hermetic compressors (compressors in which both the drive motor and compression mechanism are disposed in a hermetic shell), including those of the scroll type, can be categorized as being of the high or low side type. A high side compressor is one in which the drive motor is disposed in a portion of the compressor shell in which discharge gas is found and which is at compressor discharge pressure when the compressor is in operation. A low side compressor is one in which the drive motor is disposed in the portion of the compressor shell in which suction gas is found and which is at suction pressure when the compressor is in operation.

It has prospectively been determined, with respect to hermetic co-rotating scroll compressors, to be advantageous to employ a high side design and to use the drive shaft of the drive scroll member to communicate compressed refrigerant gas out of the compressor's compression mechanism into the discharge pressure portion of the compressor shell. Exemplary in that regard are U.S. Pat. Nos. 4,927,339 and 5,080,566, the former being assigned to the assignee of the present invention and being incorporated herein by reference.

It has also prospectively been determined to be advantageous in such a compressor to use the pressure that exists in the discharge pressure portion of the shell of the compressor (when the compressor is in operation) to drive oil from an oil sump in the discharge pressure portion of the shell to the bearings in which the scroll members are rotatably supported. It is, of course, known to be advantageous to cool oil used for bearing lubrication purposes prior to the use of such oil in the lubrication process. It is likewise known to be advantageous, with respect to compressor efficiency and reliability, to minimize the heating of compressor suction gas prior to entry of that gas into a compressor's compression mechanism.

These advantages are difficult to achieve in hermetic compressors, particularly (1.) where the source of bearing lubricant is a sump in the relatively hot discharge pressure portion of the compressor's hermetic shell, (2.) where the compressor's compression mechanism is in the suction pressure portion of its shell and (3.) where one of the bearings being lubricated comprises a boundary between the discharge pressure portion and suction pressure portion of the compressor. There continues to be a need for a viable arrangement in a hermetic high-side co-rotating scroll compressor by which to cool the oil used to lubricate such bearings and by which to prevent or minimize the entry of such bearing lubricant, subsequent to its having been heated in the bearing lubrication process, into the suction pressure portion of the compressor shell.

SUMMARY OF THE INVENTION

It is an object of the present invention to provide for the lubrication of the bearings in which the scroll members in a high-side co-rotating scroll compressor are rotatably accommodated.

It is a further object of the present invention to provide for the cooling of oil used for the lubrication of the bearings in which the scroll members in a high-side co-rotating scroll compressor are accommodated, prior to the use of that oil for bearing lubrication purposes, where the source of such oil is an oil sump in the discharge pressure portion of the compressor shell.

It is a further object of the present invention to provide for the return of oil used to lubricate the bearing in which the drive shaft of the drive scroll member in a high-side co-rotating scroll compressor is rotatably accommodated, subsequent to the use of that oil for bearing lubrication purposes, to the discharge pressure portion of the compressor in a manner which limits or prevents the entry of that lubricant into the suction pressure portion of the compressor.

Finally, it is an object of the present invention to cool the oil used to lubricate the bearings in which the scroll members of a co-rotating scroll compressor are rotatably accommodated, prior to the use of that oil to lubricate the bearings, by transferring heat from that oil to the compressor ambient while preventing or limiting the entry of such oil, after having lubricated the bearing in which the drive scroll member drive shaft is rotatably accommodated, into the suction pressure portion of the compressor.

These and other objects of the present invention will become apparent when the attached Drawing Figures and the following Description of the Preferred Embodiment are given full consideration.

In the compressor of the present invention, gas is discharged from a compression mechanism disposed in the suction pressure portion of a high-side co-rotating scroll compressor into and through a passage defined by the drive scroll member drive shaft. The discharge gas issues from the drive shaft into the discharge pressure portion of the compressor. The relatively hot lubricant carried in the discharge gas is disentrained from the gas within the discharge pressure portion of the compressor shell and drains to an oil sump defined at the bottom of that portion of the compressor.

Like the compressor taught in allowed co-pending U.S. patent application Ser. No. 08/125,684, assigned to the assignee hereof, and co-pending U.S. patent application Ser. No. 08/299,692, which is a divisional thereof, the compressor of the present invention includes a frame which divides the discharge pressure portion of the compressor from its suction pressure portion. The compressor shell and that frame cooperate in the definition of an annular lubricant passage through which lubricant is delivered to the bearings in which the scroll members are rotatably accommodated.

In its travel through the annular passage the relatively hot oil transfers heat to and through the relatively thin, metallic shell to the compressor ambient. Subsequent to having traversed the annular passage, the now relatively cooler lubricant is directed to the bearing surfaces in which the shafts of the scroll members are rotatably accommodated.

With respect particularly to the bearing surface in which the drive shaft of the drive scroll member is accommodated in the present invention, a significant differential pressure will exist across the interface between that bearing surface and the drive scroll member drive shaft because that interface comprises a boundary between the discharge pressure portion and suction pressure portion of the compressor. The differential pressure across that interface permits discharge pressure to drive oil from the oil sump in the discharge pressure portion of the compressor, through the lubricant passage and across the bearing surface to drive shaft interface thereby distributing lubricant across the bearing and drive shaft surfaces that require lubrication.

In order to minimize the amount of lubricant which completely crosses the interface into the suction pressure portion of the compressor after having lubricated the bearing surface to drive shaft interface, a flow path is provided by which to divert such lubricant through the drive scroll member drive shaft and into the stream of discharge gas flowing therethrough from the compression mechanism. As a result, after lubricating the bearing surface to drive shaft interface, the relatively hot lubricant, rather than entering the suction pressure portion of the compressor and heating the suction gas therein, is effectively short circuited back to the discharge pressure portion of the compressor. Both oil cooling and the limitation and/or prevention of suction gas superheating is thus accomplished, all to the advantage of compressor efficiency and reliability.

DESCRIPTION OF THE DRAWING FIGURES

FIG. 2 is an enlarged view of the lower portion of the compressor of FIG. 1.

FIG. 4 illustrates the preferred circumferential locales of the passage openings through which lubricant is conveyed to the compressor bearing surfaces.

DESCRIPTION OF THE PREFERRED EMBODIMENT

Figure 1:
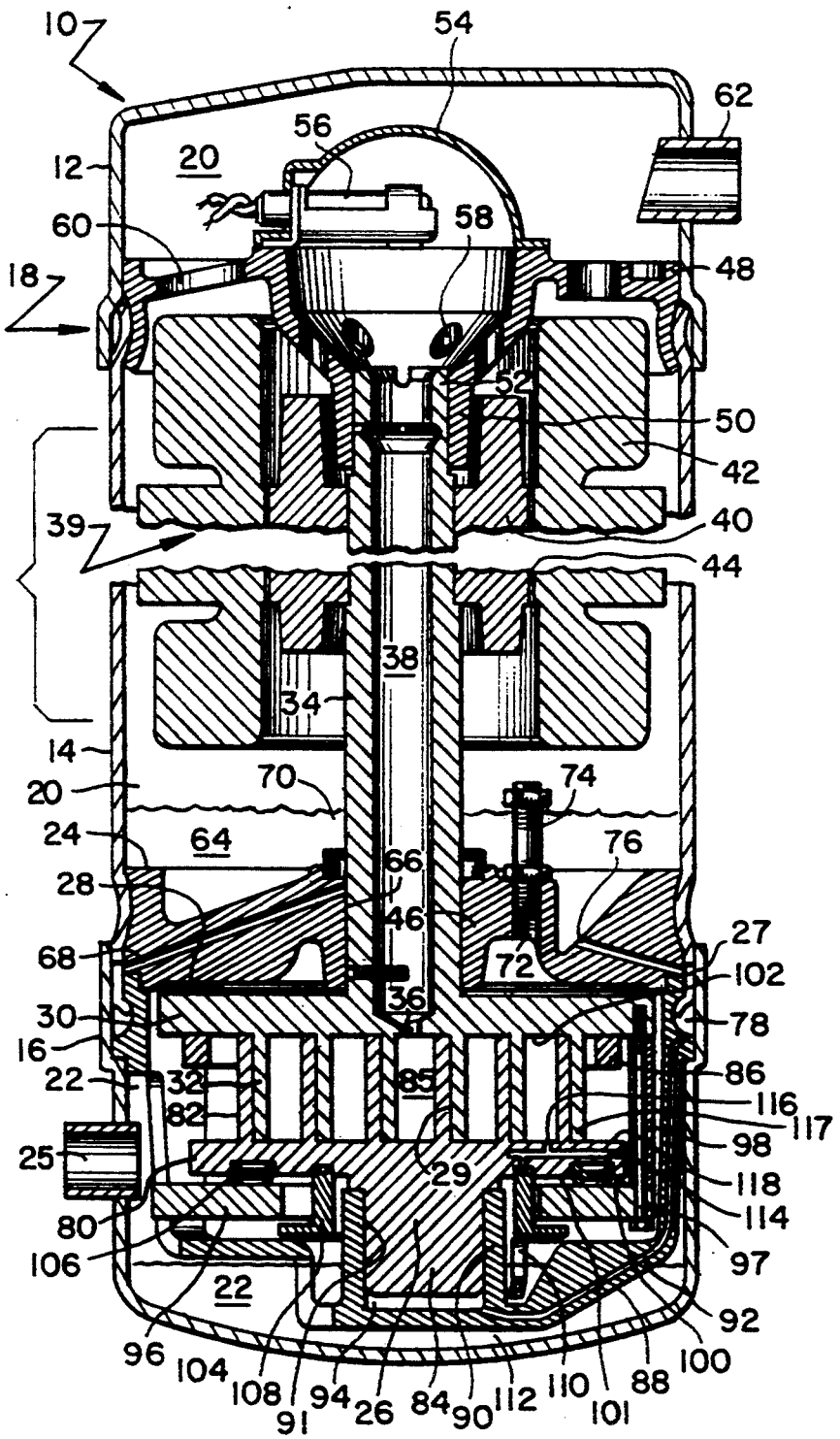
FIG. 1 is a cross sectional view of the compressor of the present invention.

Referring first to FIGS. 1 and 2, co-rotational scroll compressor 10 is comprised of an upper shell portion 12, a middle shell portion 14 and a lower shell portion 16 all of which are sealingly connected to form a hermetic shell 18. Shell 18 is divided into a discharge pressure portion 20 and a suction pressure portion 22 by a central frame 24. Suction gas is communicated into the suction pressure portion of shell 18 through suction fitting 25. Tabs 27 extend at intervals from the lower end of middle shell 14 and are utilized in the fabrication and assembly of compressor 10 in a manner which will subsequently be described.

Disposed in suction pressure portion 22 of compressor 10 is an idler scroll member 26 and a drive scroll member 28. Drive scroll and idler scroll members 26 and 28 comprise the compression mechanism 29 of co-rotating scroll compressor 10. Drive scroll member 28 is comprised of an end plate 30 from which an involute wrap 32 extends in a first direction and from which a drive shaft 34 extends in the opposite direction. End plate 30 defines a discharge port 36 which is in flow communication with a discharge passage 38 defined in the drive shaft 34 of the drive scroll member.

Motor 39 has a rotor 40 which is penetrated by and fixedly attached to the drive shaft of the drive scroll member and a stator 42 which is fixedly mounted in the discharge pressure portion 20 of compressor shell 18. A gap 44 is defined between rotor 40 and stator 42. Drive shaft 34 of the drive scroll member is rotatably carried in middle bearing housing 46 of central frame 24 within shell 18.

Upper frame 48 of compressor 10 includes an upper bearing housing 50 in which distal end 52 of drive shaft 34 is rotatably carried. Mounted on upper frame 48 is an oil separator dome 54 which is penetrated by an internal overload device 56. Upper frame 48 defines a first series of apertures 58 through which discharge gas issuing from passage 38 of drive shaft 34 passes as well as a second set of apertures 60 through which discharge gas passes prior to exiting upper shell portion 12 of the compressor through discharge fitting 62.

Defined at the bottom of discharge pressure portion 20 of compressor 10, immediately above central frame 24, is a discharge pressure oil sump 64. Oil from sump 64 is provided to the interface between bearing surface 66 and the surface of drive shaft 34 which rotates within it through oil passage 68 as will subsequently be described. A shaft seal 70 may be mounted in middle bearing housing 46 so as to sealingly surround drive shaft 34.

Middle bearing housing 46 also defines an aperture 72 between suction pressure portion 22 and discharge pressure portion 20 of compressor 10. Aperture 72 is preferably at least partially threaded and an internal pressure relief valve 74 is threaded thereinto. Also defined by central frame 24 is an oil passage 76 which communicates with a circumferential oil passage 78. Passage 78 is at least partially defined by shell 18 and supplies oil, as will further be described, from sump 64 to passage 68.

Idler scroll member 26 has an end plate 80 from which involute wrap 82 extends in a first direction and from which a stub shaft 84 extends in the opposite direction. Involute wrap 82 of idler scroll member 26 is in interleaved engagement with involute wrap 32 of drive scroll member 28 and cooperates therewith to define discharge pocket 85 which is in flow communication through discharge port 36 with passage 38 defined in drive shaft 34. An Oldham coupling 86 maintains the relative angular orientation of the wraps of the scroll members in operation and drivingly couples the drive scroll member 28 to the idler scroll member 26.

Lower frame 88 is disposed in suction pressure portion 22 of shell 18 and includes an integral bearing housing 90 in which stub shaft 84 of the idler scroll member is rotatably accommodated. Frame 88 is secured to central frame 24 during the assembly of compressor 10 by the deformation of tabs 27 which extend from middle shell portion 14 of the compressor in a manner which secures lower frame 88 to central frame 24. Together, central frame 24 and lower frame 88 can be considered to be a single frame element comprised of first and second frame portions (central frame 24 and lower frame 88) in which the two scroll members which comprise the compressor's compression mechanism are accommodated for rotation.

Lower shell portion 16 is then fit over and secured to middle shell 14 such as by a welding process. Once assembled, the component parts of compressor 10, including lower frame 88, central frame 24, middle shell portion 14 and lower shell portion 16 cooperate in the definition of circumferential lubricant passage 78.

Lower frame 88 preferably defines an oil passage 92 which is in flow communication with both circumferential oil passage 78 and space 94 defined by stub shaft 84 and lower bearing housing 90. The bearing surface 91 of lower bearing housing 90 in which idler stub shaft 84 rotates is provided with lubricant driven from discharge pressure sump 64 through passages 76, 78 and 92 and through space 94 by the discharge pressure to which sump 64 is exposed when compressor 10 is in operation. Like the interface between middle bearing surface 66 and drive scroll member drive shaft 34, the interface between lower bearing surface 91 and stub shaft 84 of the drive scroll member may comprise a boundary between the discharge and suction pressure portions of the compressor shell.

Figure 3:
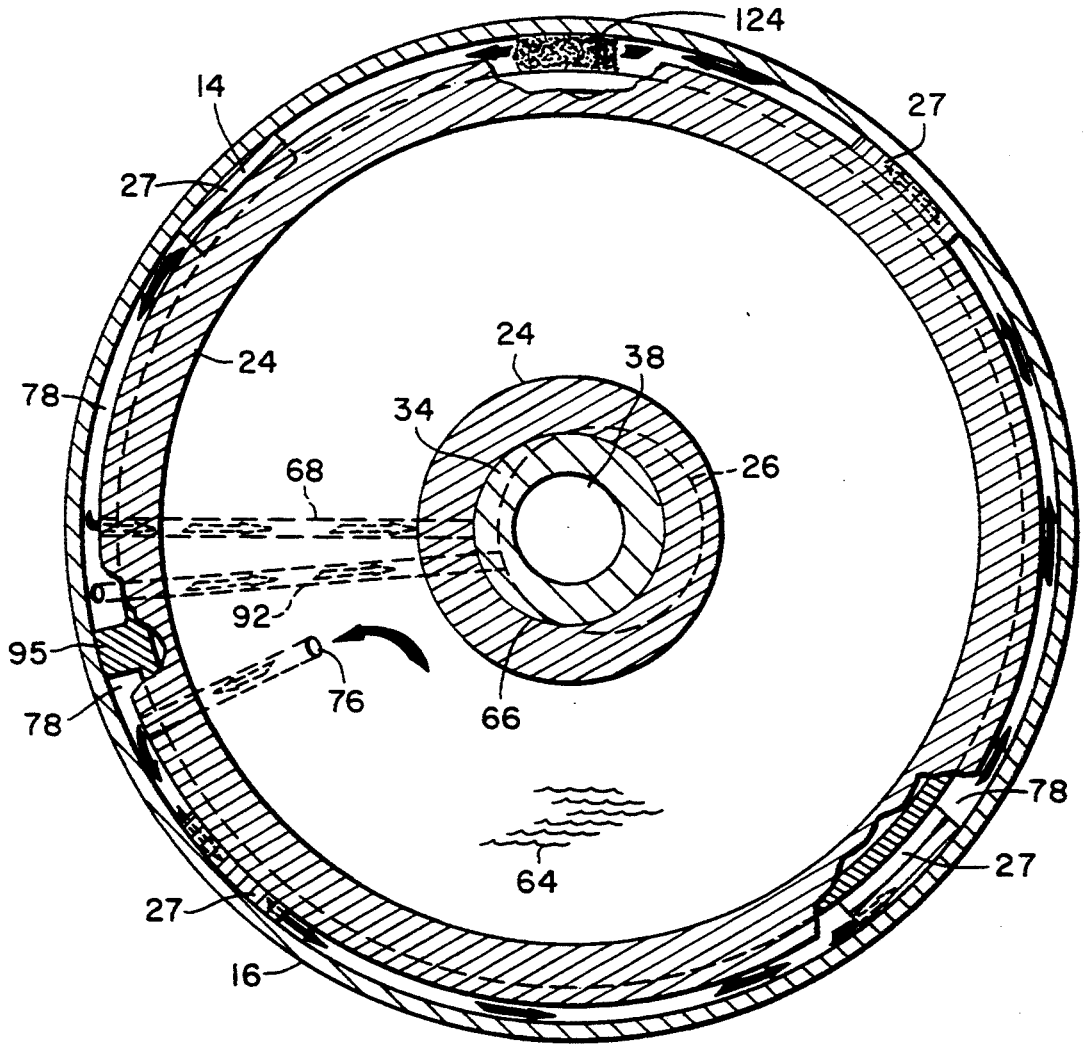
FIG. 3 is an enlarged view of the upper central portion of FIG. 2 which further illustrates the flow of lubricant to and from the interface between the drive scroll member drive shaft and the bearing surface in which it rotates.

Referring additionally now to FIG. 3, an oil stop 95 isolates the outlet of passage 76, which is where lubricant from discharge pressure sump 64 enters circumferential passage 78, from the outlets of passage 78, which is where cooled lubricant enters oil passages 68 and 92 for subsequent delivery to the scroll member bearing surfaces. Stop 95 constrains the flow of lubricant to be in one direction, through and around the entire length of circumferential passage 78 prior to its being delivered to the scroll member bearing surfaces.

It is to be noted that in FIGS. 1 and 2, which are cross-sectional in nature for convenience of understanding the present invention, each of lubricant passages 68, 76 and 92 are illustrated as being in flow communication with circumferential passage 78 which is, in fact, the case. However, the preferred circumferential locales of the outlet of passage 76 into passage 78 and the preferred circumferential locales of the outlets from passage 78 into passages 68 and 92 are best illustrated in FIG. 3.

As will be appreciated, the preferred locales referred to in the immediately preceding sentence are such that the oil used to lubricate the scroll member bearing surfaces will be constrained to flow around the entire circumference of compressor 10 to obtain the maximum oil cooling effect prior to the delivery of that oil to the scroll member bearing surfaces through passages 68 and 92. While this is the preferred embodiment to maximize the oil cooling effect, it should not be considered as limiting. Oil flow around substantially less than the entire circumference of shell 18 will still provide at least a degree of the desired oil cooling effect.

Referring once again now primarily to FIGS. 1 and 2, attached to drive scroll member 28 for rotation therewith is a pressure plate 96. Pressure plate 96 can be a unitary member having a plurality of legs which extend upwardly therefrom for attachment to drive scroll end plate 30. Such a unitary member is illustrated in copending U.S. patent application Ser. No. 08/125,684, which is assigned to the assignee of the present invention. Alternatively, and as is illustrated in FIGS. 1 and 2, pressure plate 96 may be attached to drive scroll end plate 30 by a plurality of fasteners 97 and spacers 98. Spacers 98 define the distance between the surface 100 of pressure plate 96 which is juxtaposed the under surface 101 of idler scroll member end plate 80 and the surface 102 of the drive scroll member from which the drive scroll involute wrap extends.

Idler scroll end plate 80 defines an annular groove 104 in its under surface 101 in which an annular seal 106 is disposed. Seal 106 is in sliding contact with surface 100 of pressure plate 96. In operation, a fluid available from within the compressor at a pressure greater than compressor suction pressure, such as the gas undergoing compression between the scroll wraps or lubricant from discharge pressure sump 64 or elsewhere, is communicated through a passage (not shown) that opens into groove 104. As a result, seal 106 is pressure biased toward pressure plate surface 100 and the idler scroll member is, in response, axially pressure biased toward the drive scroll member.

Also carried by idler scroll member 26 is an annular lubricant pickup member 108 which includes a depending portion 110 having a distal end disposed in lubricant sump 112 of suction pressure portion 22 of the compressor shell. Pickup member 108 defines a passage which is in flow communication with a lubricant passage 114 defined in idler scroll member 26 and lubricant sump 112.

The rotation of lubricant pickup member 108 within sump 112 causes lubricant to flow from sump 112 through pickup member 108 and into lubricant passage 114 in the idler scroll member. A portion of such lubricant may be directed through a branch passage 116 of passage 114 to an opening in the surface 118 of idler scroll member 26 from which idler scroll wrap 82 extends. The lubricant directed through branch passage 116 lubricates the interface between the tip 117 of drive scroll involute 32 and surface 118 of the idler scroll member and becomes entrained in the gas being compressed in compression mechanism 29.

Referring now to all of the Drawing Figures, the oil management arrangement of the present invention will more thoroughly be described. Oil disentrained from the gas issuing from the distal end of drive shaft 34 of the drive scroll member will drain downwardly in the discharge pressure portion 20 of compressor shell 18 past motor 39 and into sump 64. Oil is driven out of discharge pressure sump 64 through passage 76 defined by central frame 24 into circumferential oil passage 78 which is defined, once again, at least in part by compressor shell 18. The oil flows through circumferential passage 78 in direct contact with shell 18 which is exposed to the ambient conditions surrounding the compressor.

Typically, compressors of the type taught herein will be disposed in so-called air conditioner "outdoor units" which house a heat exchanger, the compressor, a fan and controls, in addition to other miscellaneous unit components. As such, when speaking of the "compressor ambient", what is referred to will typically be outdoor air at ambient outdoor air temperatures. "The ambient" referred to herein will, therefore, in most foreseeable cases comprise an atmosphere the temperature of which is less than the temperature of the oil found in discharge pressure sump 64 of compressor 10 when the compressor is in operation.

It will be appreciated that by its direct contact with shell 18, oil flowing out of passage 76 into and through circumferential passage 78 will come into direct contact with shell 18 and will, by virtue of the temperature differential across the compressor shell in the location of passage 78, transfer at least a portion of its heat to and through the compressor shell and to the compressor ambient. Such cooled oil enters passage 68 defined in middle frame 24 and passage 92 defined in lower frame 88 and is thence directed respectively to bearing surface 66 in which drive shaft 34 of the drive scroll member rotates and bearing surface 91 in which stub shaft 84 of the idler scroll member rotates. Bearing lubrication is therefore enhanced by the provision to the bearing surfaces of oil which is cooler than had it been directed from sump 64 directly to the bearing surfaces.

Bearing surface 66, as has been indicated, comprises a boundary between the discharge pressure portion 20 of shell 18 and its suction pressure portion 22. As has also been mentioned, lubricant communicated through passage 68 to bearing surface 66 will be urged by the differential pressure acting across the interface of bearing surface 66 with the shaft of the drive scroll member downward across the bearing surface toward suction pressure portion 22 of the compressor shell.

To the extent possible, it is advantageous to prevent the entry of the oil used to lubricate bearing surface 66, which will be relatively hot as compared to the suction gas which is drawn into the compression mechanism 29, into the suction pressure portion of the shell. By doing so, heating of the suction gas prior to its compression is avoided or minimized which is advantageous to the efficiency and reliability of the compressor.

In order to avoid or minimize such suction gas heating, at least one passage 120 is defined in drive shaft 34. Passage 120 communicates between passage 38 defined by the drive shaft and the interface between bearing surface 66 and drive shaft 34. Passage 120 will preferably be juxtaposed the lower end of middle bearing housing 46 to ensure that the oil directed to bearing surface 66 is able to flow thereacross to provide for adequate lubrication along the entire length of the bearing surface to drive shaft interface.

It will be appreciated that the location at which passage 68 opens to bearing surface 66 will preferably be in the uppermost portion of bearing surface 66 so that oil is delivered to the bearing surface at a point from which it will migrate or be driven across essentially the entire length of the bearing surface by discharge pressure. Discharge pressure will urge oil from the location at which the oil delivery passage opens into the bearing surface toward the suction pressure portion of the compressor shell.

As has been described above, passage 38 is the passage by which refrigerant gas compressed in compression mechanism 29 is communicated from discharge pocket 85 of the compression mechanism to the discharge pressure portion of the compressor shell. It will be appreciated that high temperature discharge gas is communicated from compression mechanism 29 at a relatively high rate and velocity because of the high speed of rotation of the scroll members which comprise the compression mechanism. As such, the flow of compressed gas past aperture 120 in drive shaft 34 will create a venturi-like effect the result of which will be to draw lubricant, which has migrated across bearing surface 66, through aperture 120 and into the discharge gas stream flowing through passage 38.

As has been noted, the discharge gas stream will already contain oil picked up in the suction pressure portion of the shell such as, for example, from the delivery of oil through passage 116 in the idler scroll end plate into the compression mechanism. Aperture 120 therefore effectively short circuits the lubricant flow path within the compressor, with respect to the oil which lubricates bearing surface 66, such that at least a portion of the lubricant used to lubricate bearing surface 66 is prevented from passing into the suction pressure portion of the compressor. By diverting at least a portion of such lubricant into passage 38, when it would otherwise flow into suction pressure portion 22 of the compressor shell, the heating of suction gas in the suction pressure of the shell is reduced which enhances the efficiency and reliability of the compressor.

It is to be noted that a conduit-like member 122 may be disposed in aperture 120 in a manner such that it extends into the interior of passage 38. Because shaft 34 is rotating at high speed and because oil is already entrained in the gas discharged from discharge pocket 85 into passage 38, a portion of such already entrained oil will be disentrained immediately upon its entry into passage 38 by the centrifugal forces to which it is exposed therein. Such oil will flow up the inner surface of drive shaft 34. Absent the use of member 122, such disentrained oil might effectively clog aperture 120 or prevent the creation of a venturi-like effect at its opening into passage 38 which would impair or prevent the entry of lubricant thereinto after having lubricated bearing surface 66.

Referring to FIG. 4, it is to be noted that the effectiveness of passage 120 or multiples thereof might potentially be increased by the definition of a circumferential passage 121 (illustrated in phantom in FIG. 4) in flow communication with passage 120. Such circumferential passage could be defined in drive shaft 38 or in bearing surface 66. It is also to be appreciated, referring once again to FIG. 3, that a filter 124 such as a fine mesh screen can be disposed in passage 78 in a manner which traps debris in the oil flowing through passage 78 so as to prevent such debris from reaching bearing surfaces 66 and 91.

While the present invention has been described in terms of a preferred embodiment, is will be appreciated that other modifications thereto will be apparent to those skilled in the art given the teachings provided hereby. Therefore, the present invention is not limited to the embodiments described and illustrated herein but includes other equivalent embodiments which fall within the scope of the language of the claims which follow.

What is claimed is:

1. A scroll compressor comprising:

a shell, said shell defining a discharge pressure portion and a suction pressure portion, said discharge pressure portion defining a lubricant sump;

a first scroll member, said first scroll member being rotatably disposed in said shell and having a shaft extending therefrom;

a second scroll member, said second scroll member being rotatably disposed in said shell, said first and said second scroll members constituting a gas compression mechanism; and a frame, said frame defining a boundary between said suction pressure portion and said discharge pressure portion of said shell and having a bearing surface in which said shaft of said first scroll member rotates, said frame and said shell cooperatively defining a lubricant passage which is at least partially circumferential of said shell so that lubricant flowing therethrough flows at least partially around the circumference of said shell in heat exchange therewith, said lubricant passage being in flow communication with said sump and said bearing surface, said bearing surface being lubricated with lubricant which flows from said lubricant sump through said circumferential lubricant passage prior to its delivery to said bearing surface.

2. The scroll compressor according to claim 1 wherein said frame defines a first lubricant passage, said first lubricant passage communicating between said lubricant sump and said lubricant passage cooperatively defined by said frame and said shell.

3. The scroll compressor according to claim 2 wherein said frame defines a second lubricant passage, said second lubricant passage communicating between said cooperatively defined lubricant passage and said bearing surface.

4. The scroll compressor according to claim 3 wherein the outlet of said first lubricant passage opening into said cooperatively defined lubricant passage upstream of the inlet from said cooperatively defined lubricant passage into said second lubricant passage.

5. The compressor according to claim 4 wherein said shaft of said first scroll member defines a discharge passage by which compressed gas is delivered from said compression mechanism to said discharge pressure portion of said shell.

6. The scroll compressor according to claim 5 wherein said shaft defines a lubricant passage communicating between said bearing surface and said discharge passage.

7. The scroll compressor according to claim 6 wherein at least a portion of the lubricant communicated to said bearing surface for the lubrication thereof through said cooperatively defined lubricant passage and said second lubricant passage flows into and through said lubricant passage defined by said shaft after having lubricated said bearing surface.

8. The scroll compressor according to claim 7 further comprising means, extending into the interior of said discharge passage defined by said shaft, for communicating lubricant which flows into and through said lubricant passage defined by said shaft from said bearing surface into the discharge gas stream flowing through said shaft discharge passage when said compressor is in operation.

9. The scroll compressor according to claim 4 wherein said scroll compressor includes a second bearing surface in which said second scroll member is rotatably disposed, said frame defining a third lubricant passage communicating between said cooperatively defined lubricant passage and said second bearing surface.

10. The scroll compressor according to claim 9 wherein the inlet to said third lubricant passage from said cooperatively defined lubricant passage is downstream of the outlet of said first lubricant passage into said cooperatively defined lubricant passage so that the lubricant which lubricates said second bearing surface is constrained to flow through at least a portion of said cooperatively defined lubricant passage in a heat exchange relationship with said shell prior to its delivery to said second bearing surface.

11. The scroll compressor according to claim 10 wherein said frame is comprised of a first frame portion and a second frame portion, said first frame portion defining said first and said second lubricant passages, said second frame portion defining said third lubricant passage.

12. A scroll compressor comprising:

a shell, said shell defining a discharge pressure portion and a suction pressure portion, said discharge pressure portion defining a lubricant sump;

a first scroll member, said first scroll member being rotatably disposed in said shell and having a shaft extending therefrom, said shaft defining a discharge passage and a lubricant passage;

a second scroll member rotatably disposed in said shell, said first and said second scroll members constituting a gas compression mechanism, said gas compression mechanism having a discharge port upstream of said discharge passage; and a frame, said frame defining a boundary between said suction pressure portion and said discharge pressure portion of said shell and having a bearing surface in which said shaft of said first scroll member rotates, said bearing surface being in flow communication with said discharge passage through said lubricant passage defined by said shaft, said lubricant passage opening into said discharge passage downstream of said discharge port.

13. The scroll compressor according to claim 12 wherein said lubricant passage defined by said drive shaft is located in said shaft such that at least a portion of the lubricant delivered to said bearing surface for the lubrication thereof enters said lubricant passage defined by said drive shaft after lubricating said bearing surface, said lubricant portion being delivered through said lubricant passage defined by said drive shaft, into said discharge passage and being returned to said sump in said discharge pressure portion of said shell without having entered said suction pressure portion of said shell.

14. The scroll compressor according to claim 13 wherein said frame and said shell cooperate in the definition of a lubricant passage, lubricant used in the lubrication of said bearing surface being constrained to flow through said cooperatively defined lubricant passage prior to lubricating said bearing surface.

15. The scroll compressor according to claim 14 wherein said lubricant passage cooperatively defined by said frame and said shell is in flow communication with said sump in said discharge pressure portion of said shell, lubricant from said sump in said discharge pressure portion of said shell being constrained to flow through said cooperatively defined lubricant passage in a heat exchange relationship with said shell prior to lubricating said bearing surface.

16. The scroll compressor according to claim 15 wherein said frame defines a first lubricant passage and a second lubricant passage, said first lubricant passage communicating between said sump in said discharge pressure portion of said shell and said lubricant passage cooperatively defined by said frame and said shell, said second lubricant passage communicating between said cooperatively defined lubricant passage and said bearing surface.

17. The scroll compressor according to claim 16 wherein frame is comprised of a first frame portion and a second frame portion, said first frame portion defining said first lubricant passage and said second lubricant passage, said second frame portion having a bearing surface in which said second scroll member rotates and defining a lubricant passage between said cooperatively defined lubricant passage and said bearing surface of second frame portion, the entrances to both said second lubricant passage in said first frame portion and said lubricant passage defined by said second frame portion being downstream of the location at which lubricant from said discharge pressure sump enters said cooperatively defined lubricant passage so that both said bearing surface in said first frame portion and said bearing surface in said second frame portion are lubricated with lubricant which has passed through said cooperatively defined passage in a heat exchange relationship with said shell prior to lubricating said bearing surfaces.

18. The scroll compressor according to claim 13 wherein said discharge passage defined in said shaft is a passage through which a discharge gas stream flows from said compression mechanism into said discharge pressure portion of said shell and wherein said drive shaft has a wall which defines said discharge passage, said scroll compressor further comprising means for delivering lubricant which flows through said lubricant passage defined by said drive shaft into said discharge gas stream at a location radially inward of the wall of said drive shaft which defines said discharge passage.

19. A method of bearing lubrication in a scroll compressor comprising the steps of:

mounting a frame in said compressor so as to divide the shell of said compressor into a suction pressure portion and a discharge pressure portion;

disposing a first bearing surface in said frame;

collecting lubricant in a sump in the discharge pressure portion of said compressor;

defining a lubricant passage in said compressor said passage being at least partially defined by said shell of said compressor and said passage running circumferentially of said shell;

flowing lubricant from said sump circumferentially around said shell in said lubricant passage in a heat exchange relationship with said shell; and delivering at least a portion of said lubricant to said first bearing surface from said lubricant passage subsequent to said flowing step.

20. The method according to claim 19 further comprising the step of communicating lubricant, subsequent to said delivering step, into the stream of gas discharged into said discharge pressure portion of said shell so that said communicated lubricant is delivered back to said discharge pressure portion of said shell and to said lubricant sump without having entered said suction pressure portion of said shell.

21. The method according to claim 19 comprising the further steps of disposing a second bearing surface in said frame and delivering said lubricant, after said flowing step, to both of said bearing surfaces in said frame.

22. A method of bearing lubrication in a scroll compressor comprising the steps of:

dividing the shell of said compressor into a discharge pressure portion and a suction pressure portion;

collecting relatively hot lubricant in a sump in the discharge pressure portion of said compressor;

compressing a gas in a compression mechanism within said compressor;

defining a path for the flow of gas compressed in said compressing step out of said compression mechanism and into said discharge pressure portion of said shell;

delivering said lubricant from said sump to said bearing surface; and defining a path for at least a portion of the lubricant delivered to said bearing surface in said delivering step back to said sump in said discharge pressure portion of said shell so that said lubricant portion is returned back to said sump without having entered said compression mechanism or said suction pressure portion of said shell.

23. The method according to claim 22 further comprising the steps of defining a lubricant passage in said compressor, said passage being at least partially defined by the shell of said compressor; and, flowing said relatively hot lubricant from said sump in said discharge pressure portion of said shell through said passage in a heat exchange relationship with said shell prior to said step of delivering said lubricant to said bearing surface.

24. The method according to claim 23 further comprising the steps of:

mounting a scroll member drive shaft for rotation in said bearing surface;

defining a passage in said drive shaft by which discharge pressure gas is communicated into said discharge pressure portion of said compressor; and defining a passage communicating between said bearing surface and said drive shaft passage.

* * * * *